US005730436A

United States Patent [19]

Viebach et al.

[11] Patent Number: 5,730,436

[45] Date of Patent: Mar. 24, 1998

[54] SIGNATURE CONVEYOR SYSTEM WITH AUTOMATIC PHASE ADJUSTMENT

[75] Inventors: Hans Joachim Viebach, New Lenox; Ronald W. Hastie, Elk Grove Village, both of Ill.; Arthur J. Gawlinski, Munster, Ind.; Kenneth E. Kruse, Redondo Beach, Calif.

[73] Assignee: R. R. Donnelley & Sons Company, Chicago, Ill.

[21] Appl. No.: 569,281

[22] Filed: Dec. 8, 1995

Related U.S. Application Data

[63] Continuation-in-part of Ser. No. 390,473, Feb. 17, 1995, abandoned.

[51] Int. Cl.[6] ..... B65H 39/00

[52] U.S. Cl. ..... 270/52.16; 270/52.29; 270/58.01

[58] Field of Search ..... 270/52.14, 52.16, 270/52.26, 52.29; 271/9.12, 9.13, 9.14; 198/418.1, 418.2, 418.3, 371.2, 375, 376

[56] References Cited

U.S. PATENT DOCUMENTS

| | | | |
|---|---|---|---|
| 2,812,940 | 11/1957 | Kes, Jr. | 271/50 |
| 3,249,483 | 5/1966 | Kauffman et al. | 270/58 X |
| 3,492,955 | 2/1970 | Gallagher | 112/21 |
| 3,825,247 | 7/1974 | Fernandez-Rana et al. | 270/58 |
| 4,241,907 | 12/1980 | McCain et al. | 270/54 |
| 4,296,654 | 10/1981 | Mercer | 81/57.26 |
| 4,451,031 | 5/1984 | McCain et al. | 270/303 |
| 4,511,130 | 4/1985 | Barton et al. | 270/54 |
| 4,753,430 | 6/1988 | Rowe et al. | 270/58 |
| 4,789,147 | 12/1988 | Berger et al. | 270/52.16 X |
| 4,869,484 | 9/1989 | Hastie | 270/54 |
| 5,080,341 | 1/1992 | Luthy | 270/52 |
| 5,279,495 | 1/1994 | Rello | 270/54 |
| 5,458,323 | 10/1995 | Magee et al. | 270/52.16 X |
| 5,462,266 | 10/1995 | Meier | 270/52.16 |

FOREIGN PATENT DOCUMENTS

| | | |
|---|---|---|
| 61-299771 | 10/1986 | Japan . |
| 4-269594 | 9/1992 | Japan . |

*Primary Examiner*—Hoang Nguyen

*Attorney, Agent, or Firm*—Marshall, O'Toole, Gerstein, Murray & Borun

[57] ABSTRACT

A signature conveyor system with automatic phase adjustment capability includes a conveyor for conveying a plurality of sheets in a conveyance direction wherein the conveyor is subdivided into a plurality of conveyor spaces and a motor for causing the conveyor to move at a speed in the conveyance direction. Packer boxes are spaced along the conveyor and each packer box periodically releases one of the sheets above the conveyor at a release time as the conveyor moves past the packer box. A phase changer is operatively coupled between the conveyor and the packer boxes and adjusts the release time based upon the speed of the conveyor.

6 Claims, 3 Drawing Sheets

SIGNATURE CONVEYOR SYSTEM WITH AUTOMATIC PHASE ADJUSTMENT

CROSS-REFERENCE TO RELATED APPLICATION

The present application comprises a continuation-in-part of U.S. application Ser. No. 08/390,473, filed Feb. 17, 1995 and entitled "Signature Conveyor With Automatic Phase Adjustment," now abandoned.

TECHNICAL FIELD

The present invention is generally directed to conveyor systems, and more particularly to a system for collating and conveying signatures having printed subject matter thereon prior to binding of such signatures into books, magazines, and the like.

BACKGROUND ART

A conventional binding line for assembling signatures into books includes a plurality of packer boxes disposed adjacent to a conveyor in the form of a gathering chain. The gathering chain is subdivided into chain spaces by a plurality of lugs which are adjustably positioned on the chain. The gathering chain and packer boxes are coupled together by packer box clutches and are driven in synchronized fashion by a motor. During steady-state operation of the binding line, each packer box is operable at each of a plurality of points of time to release a signature from a position above the conveyor. The signature then free-falls onto a particular chain space. As the chain continues to move past the packer boxes, further signatures are fed to the chain spaces to assemble the books. The books are stitched, then trimmed, and otherwise finished by finishing apparatus.

It is important to accurately control the point in each chain space to which signatures are fed. This has been accomplished in the past by separately adjusting the relative synchronization of each packer box to the binding line, in turn by disengaging each packer box clutch, performing the necessary mechanical adjustments and reengaging each clutch. This synchronization is effective to obtain precise positioning, however, only for a particular binding line speed during steady state operation.

If it is desired to change the binding line speed, or during start-up or shut-down of the binding line, the positions of the signatures deposited in the chain spaces change, sometimes with a negative impact on the production process. This results from the inability to adequately control the transit time of the signature during free fall. This problem can be addressed by increasing the spacing between adjacent lugs so that the chain spaces are made larger; however, the speed of the gathering chain must then be increased in order to maintain the same throughput. This speed increase undesirably increases the frequency of jams, places undesirable stresses on the gathered signatures and creates problems in the downstream finishing apparatus and hence is a poor solution to the problem.

SUMMARY OF THE INVENTION

The invention overcomes the above problems by automatically adjusting the time at which each of the packer boxes releases a signature above the moving conveyor, based upon the speed of the binding line.

According to one aspect of the invention, a signature conveyor system includes a conveyor for conveying a plurality of sheets in a conveyance direction wherein the conveyor is subdivided into a plurality of conveyor spaces, a motor operable to move the conveyor at a speed in the conveyance direction and a plurality of packer boxes disposed adjacent the conveyor and spaced along the conveyance direction. Each packer box periodically releases one of the sheets from a distance above the conveyor as the conveyor moves past the packer box. The signature conveyor system further includes adjustment means for automatically adjusting the release time relative to the speed of the conveyor.

In the preferred embodiment, the conveyor comprises a chain having a plurality of spaced lugs defining the conveyor spaces. Also, preferably, the adjustment means includes a controller responsive to a signal representing conveyor speed and a phase changer operatively coupled to the packer boxes wherein the phase changer causes the release time to be changed based upon the signal. Still further in accordance with the preferred embodiment, the controller includes means for operating the phase changer in synchronism with the movement of the conveyor.

The signature conveyor system may also include means for synchronously coupling the phase changer to each of the packer boxes. Such means may comprise a common drive shaft, a plurality of first gears coupled to the common drive shaft, a plurality of second gears each associated with one of the packer boxes and connecting means for connecting each of the first gears to a respective one of the second gears. The connecting means may be in the form of chains, belts or other apparatus.

In accordance with another aspect of the present invention, a system for periodically transferring sheets having printed subject matter thereon to a conveyor includes a motor for causing the conveyor to move at a selectable speed in a conveyance direction and a plurality of packer boxes spaced along the conveyance direction of the conveyor. Each packer box periodically releases one of the printed sheets above the conveyor at a release time as the conveyor moves past the packer box. A phase changer is operatively coupled between the conveyor and the packer boxes and adjusts the release time relative to the speed of the conveyor.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
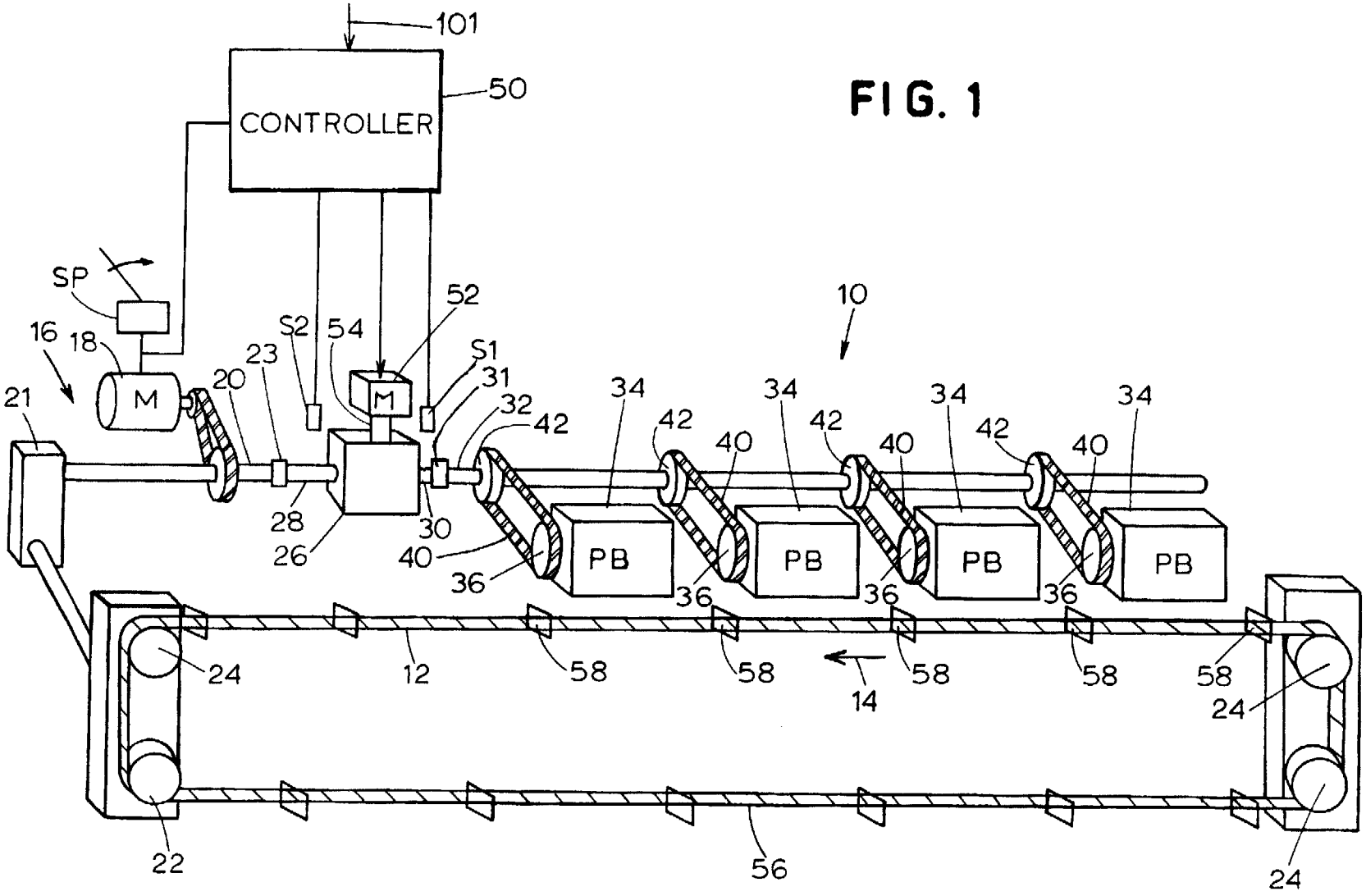
FIG. 1 is a simplified diagrammatic illustration of a preferred embodiment of a signature conveyor system in accordance with the present invention.

A preferred embodiment of a signature conveyor system in the form of a binding line 10 in accordance with the present invention is illustrated in FIG. 1. The binding line 10 includes a signature conveyor which may be in the form of a signature carrying saddle chain 12 which is driven in a conveyance direction, indicated by an arrow 14, by a drive system 16. The drive system 16 includes a motor 18 which is operable to drive a shaft 20 at a selectable speed as commanded by a speed command potentiometer SP. The shaft 20 is in turn coupled to a first gear box 21 having an output shaft which drives a wheel 22 on which the signature carrying chain 12 is supported and a first coupling 23. The signature carrying chain 12 is further supported by a plurality of idler wheels 24.

A phase changer 26 includes a rotatable input shaft 28 coupled to an output of the first coupling 23. The phase changer 26 further includes a rotatable output shaft 30 which is connected by a second coupling 31 to a rotatable drive shaft 32, wherein the drive shaft 32 acts as a common drive shaft for a plurality of packer boxes 34.

Figure 2:
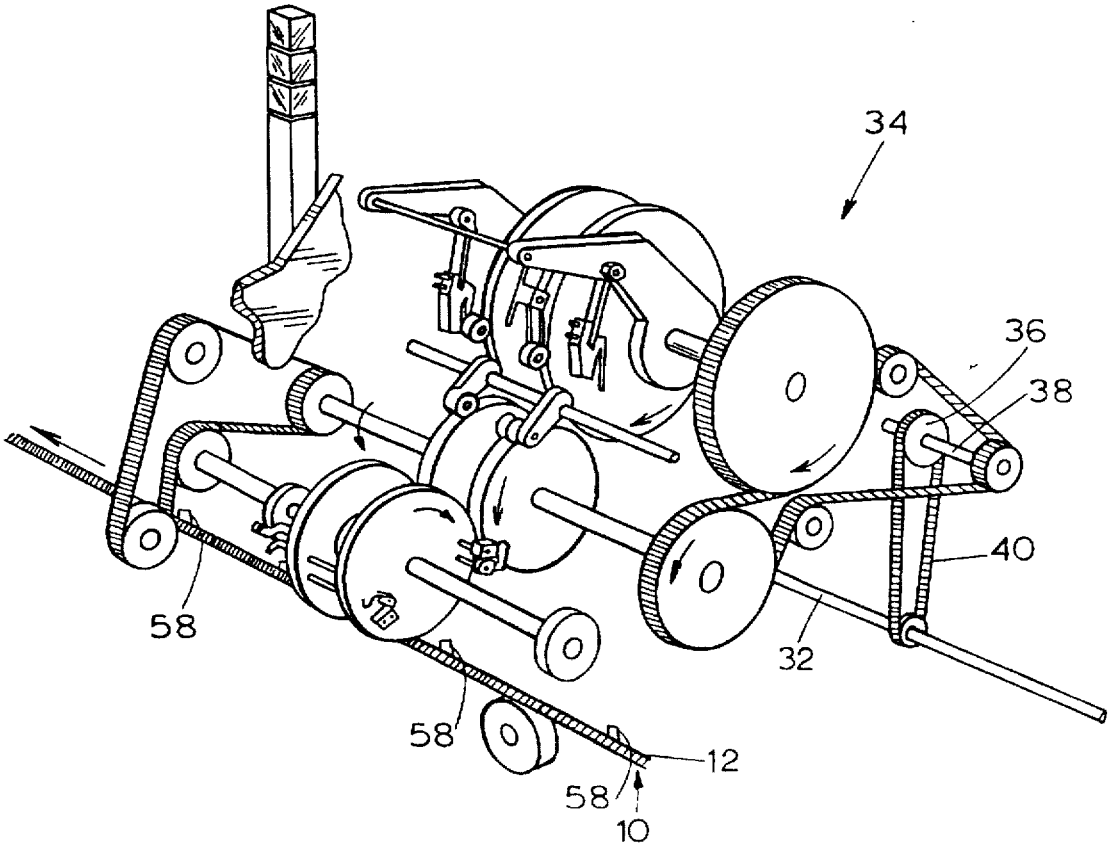
FIG. 2 is a fragmentary perspective view of an exemplary packer box and a portion of the signature carrying chain of FIG. 1.

The present invention may be adapted for use with any of a number of packer box types. For example, packer boxes of the type disclosed in Hastie U.S. Pat. No. 4,869,484, the disclosure of which is incorporated herein, may be used, if desired. As seen in FIG. 2, such a packer box 34 includes an input such as a gear sprocket or pulley 36 carried by a driven shaft 38.

A chain or timing belt 40 connects each gear sprocket or pulley 36 to an associated gear sprocket or pulley 42 carried by the shaft 32. Alternatively, equivalent mechanical and/or electrical apparatus/such as a drive shaft and u-joint, a set of gears, etc.) may interconnect the shaft 32 and the input of each packer box 34. As described in more detail below, the operation of the packer boxes 34, and thus the time at which each signature is released above the signature carrying chain 12 by each packer box 34, is controlled by the rotation of the shaft 32.

A controller 50 is responsive to a speed command signal developed at an output of the speed command potentiometer SP and is coupled to control a stepper motor 52 having a motive power output connected to a control shaft 54 of the phase changer 26. The controller 50 may also receive inputs from position sensors S1 and S2 which may be of any known type, such as a rotary shaft encoder unit, for generating a signal indicative of the rotational position or speed of a shaft. The controller 50 may be responsive to the sensors S1 and S2 to limit movement of the shaft 30 relative to the shaft 28.

The controller 50 and the motor 52 may be separate or packaged as an integral unit. In the latter case, the controller 50 and motor 52 may be of the type sold by Pacific Scientific, Motor and Control Division, of Rockford, Ill., under Model No. 5645. The controller 50 may be programmed in the Basic programming language to control the position of the output shaft of the stepper motor 52 in dependence upon the commanded speed of the motor shaft 20. The programing to effectuate this result may be developed in a straightforward manner based upon empirical measurements of conveyor chain speed versus the required position of the shaft 54 to result in proper positioning of signatures on chain spaces 56 located between adjacent pusher pins or chain lugs 58 carried by the chain 12.

The phase changer 26, which may be a conventional phase changer commercially available from Die Qua Corporation of Bloomingdale, Ill., and manufactured by Tandler under Model No. PD2C1, operates by changing the relative phase, or relative rotational position, between the input shaft 28 and the output shaft 30. The amount by which the phase between the shafts 28, 30 is changed is controlled by the rotational position of the control shaft 54 of the phase changer 26.

For example, to advance the rotational position or phase of the output shaft 30 with respect to that of the input shaft 28, the control shaft 54 is rotated in a first direction, whereas to retard the rotational position or phase of the output shaft 30 with respect to that of the input shaft 28, the control shaft 54 is rotated in a direction opposite the first direction.

As is evident from an inspection of the FIGS., the input and output shafts 28, 30 of the phase changer 26 are parallel and concentric. Different phase changers may have the input and output shafts in other orientations, such as parallel but non-concentric with respect to each other on opposite sides of the phase changer or at an angle (i.e., non-parallel) with respect to each other, in which case the structural interfacing between the phase changer 26, the motor 18, the gearbox 23 and the packer boxes 34 can be modified in a manner evident to one of ordinary skill in the art.

In operation, each packer box 34 is loaded with a supply of identical signatures, with the signatures in each packer box 34 typically being different than the signatures in the other packer boxes 34.

Figure 3:
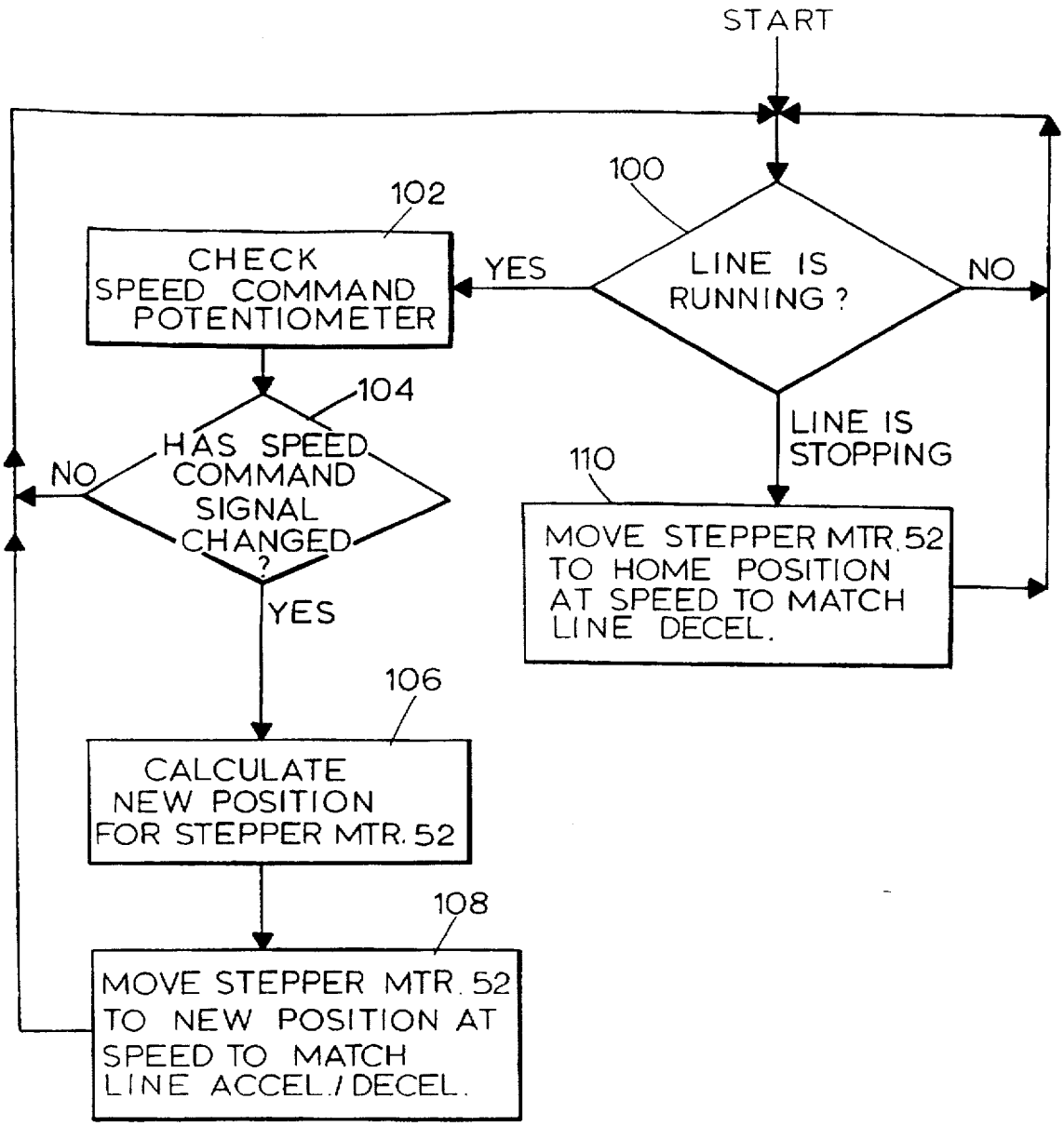
FIG. 3 is a flowchart of programming executed by the controller of FIG. 1 to implement a portion of the present invention.

After the signatures are loaded, the signature carrying saddle chain 12 is driven by the motor 18 via the drive shaft 20, the gearbox 21 and the wheel 22. The controller 50 then repetitively executes the programming of FIG. 3 to control the stepper motor 52. Generally, based on the magnitude of the speed command signal developed by the speed command potentiometer SP, the controller 50 generates a set of drive signals for the stepper motor 52, which in turn positions the control shaft 54 of the phase changer 26 to control the phase between the input and output shafts 28, 30 of the phase changer 26.

More particularly, the programming executed by the controller 50 begins at a block 100 which checks to determine whether the binding line 10 is running, for example, by checking to determine whether a high state run signal is being developed by a supervisory controller (not shown) on a line 101 coupled to the controller 50. If the line is not running, control remains with the block 100 until a determination is made that the line is running or is decelerating to a stop. If the block 100 determines that the line is running and not decelerating to a stop, control passes to a block 102. The block 102 thereafter checks the speed command potentiometer SP to obtain a current speed command signal and a block 104 compares the current speed command signal against a previous speed command signal developed during an immediately preceding pass through the programming of FIG. 3. If the current speed command signal is the same as the previous speed command signal, control returns to the block 100. On the other hand, if the block 104 determines that the current speed command signal is different than the previous speed command signal, a block 106 determines a new position for the control shaft 54 based upon the current speed command signal. The determination may be made by accessing a look-up table which stores signals representing control shaft position as a function of speed command signal magnitude, or by calculating the control shaft position signal from a curve stored in memory or by any other methodology. A block 108 then operates the stepper motor 52 to move the control shaft 54 to the new position at a speed which matches the acceleration or deceleration of the line 10. The acceleration/deceleration is calculated by the controller 50 based upon the difference between the current and immediately preceding speed command signal magnitudes and the time period that elapsed between detection of such signal magnitudes.

Control from the block 108 then returns to the block 100.

The block 100 determines that the line 10 is decelerating to a stop by detecting the transition of the run signal from a high state to a low state. If this condition is detected by the block 100, a block 110 operates the stepper motor 42 to move the control shaft 54 to a particular position (referred to as a "home position") at which no phase advance is effected by the phase changer 26. Movement to the home position occurs at a speed which matches the deceleration of the binding line 10. The line stop decaloration may be empirically determined by observation of the line 10 or may be determined in any known fashion.

It should be noted that the above control strategy may be replaced by one in which the binding line speed is directly sensed by one or more speed or position sensors which may interface with the controller 50 via A/D converters. In this case, the position of the control shaft is controlled as a function of the line speed. Also, the line acceleration/deceleration may be directly sensed, or may be calculated from the speed/position sensor output(s), if desired.

By matching the rotational speed of the shaft 54 to the acceleration or deceleration of the binding line 10, accurate positioning of signatures on the binding change is assured.

As should be evident from the foregoing, if the speed of the binding line 10 increases, the control shaft 54 is rotated to an angular position such that the relative phase between the input and output shafts 28, 30 is increased, which causes each signature to be released earlier so that it will fall to the same position within its intended chain space 56 on the signature carrying chain 12 despite the speed increase.

If the speed of the binding line 10 decreases, the relative phase between the input and output shafts 28, 30 is decreased by moving the control shaft 54 to a different angular position so that each signature will be released later in time whereby it will fall to the same position within the intended conveyor space 56 despite the decrease in speed.

Adjusting the release time of the signatures based on the speed of the line 10 is advantageous in that the signatures tend to fall to the same position within each conveyor space on the signature carrying chain 12, regardless of the speed of the binding line 10. In effect, the present invention accounts for the free-fall transit time of each signature. Consequently, the occurrence of misplaced signatures on the binding line chain 12 is reduced or eliminated. Furthermore, since the signatures tend to fall to the same position within the conveyor spaces regardless of line speed, the size of the conveyor spaces can be made smaller. Thus, for the same production level, the speed of the conveyor can advantageously be reduced in proportion to the reduction in chain pin spacing. Alternatively, if desired, the speed of the line 10 can be increased to thereby increase the number of books that can be produced by the line 10 per unit time.

The present invention reduces the incidence of misplaced signatures during start-up and shut-down of the binding line 10, thus reducing the down-time that would otherwise be required to clear misplaced signatures from the chain 12.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention and the exclusive use of all modifications which come within the scope of the appended claims is reserved.

What is claimed is:

1. A system for periodically transferring sheets to a conveyor system, comprising:

a conveyor for conveying a plurality of printed sheets in a conveyance direction, the conveyor being subdivided into a plurality of conveyor spaces;

a motor operable to move the conveyor at a speed in the conveyance direction;

a plurality of packer boxes disposed adjacent the conveyor and spaced along the conveyance direction, each packer box being periodically operable as the conveyor is moved to release one of the sheets above the conveyor at a release time;

adjustment means for automatically adjusting the release time based upon the speed of the conveyor, the adjustment means comprising a controller responsive to a signal indicative of the speed of the conveyor and a phase changer operatively coupled to the packer boxes, the phase changer causing the release time to be changed based upon the speed signal; and means for synchronously coupling the phase changer to each of the packer boxes, comprising a common drive shaft, a plurality of first gears coupled to the common drive shaft, a plurality of second gears each associated with one of the packer boxes, and connecting means for connecting each of the first gears to a respective one of the second gears.

2. The system of claim 1, wherein the connecting means comprises a plurality of chains.

3. The system of claim 1, wherein the connecting means comprises a plurality of timing belts.

4. A system for periodically transferring sheets having printed subject matter thereon to a conveyor moving in a conveyance direction, wherein the conveyor is subdivided into a plurality of conveyor spaces, comprising:

a motor for causing the conveyor to move at a selectable speed in the conveyance direction;

a plurality of packer boxes spaced along the conveyance direction of the conveyor, each packer box periodically releasing one of the printed sheets above the conveyor at a release time as the conveyor moves past the packer box;

a phase changer operatively coupled between the conveyor and the packer boxes for adjusting the release time relative to the speed of the conveyor, the phase changer including a first shaft coupled to the conveyor and a second shaft coupled to the packer boxes, and first and second position sensors generating first and second position sensors representing rotational positions of the first and second shafts of the phase changer, respectively; and means for synchronously coupling the phase changer to each of the packer boxes, the means comprising a common drive shaft, a plurality of first gears coupled to the common drive shaft, a plurality of second gears each associated with one of the packer boxes, and connecting means for connecting each of the first gears to a respective one of the second gears.

5. The system of claim 4, wherein the connecting means comprises a plurality of chains.

6. The system of claim 4, wherein the connecting means comprises a plurality of timing belts.

* * * * *